US005099460A

United States Patent [19]

Poturnicki, Jr. et al.

[11] Patent Number: 5,099,460

[45] Date of Patent: Mar. 24, 1992

[54] SONAR TRANSDUCER

[75] Inventors: Alfred Poturnicki, Jr., Duxbury; John Pagliarini, Jr., Ocean Bluff; Thomas Baldasarre, Bridgewater; Mario Delara, Boston; James Traft, Milton, all of Mass.

[73] Assignee: Seabeam Instruments, Inc., Westwood, Mass.

[21] Appl. No.: 565,730

[22] Filed: Aug. 13, 1990

[51] Int. Cl.[5] ..... H04R 17/00

[52] U.S. Cl. ..... 367/157; 367/162; 367/165; 367/159; 310/337

[58] Field of Search ..... 367/162, 157, 165, 159; 310/337, 369

[56] References Cited

U.S. PATENT DOCUMENTS 3,177,382 4/1965 Green ..... 367/159

4,156,863 5/1979 Madison et al. ..... 367/162

*Primary Examiner*—J. W. Eldred

*Attorney, Agent, or Firm*—Ladas & Parry

[57] ABSTRACT

The sonar transducer includes a metal core about which is situated a cylindrical piezoelectric ceramic ring element with paper interposed therebetween. In order to improve resistance to fracture resulting from mechanical shock, in one embodiment, the core is reduced in diameter, such that a potting compound can be situated between the paper and the ring. In a second embodiment, the ring element is divided into two individual, axially aligned cylindrical ring subelements with a gasket interposed therebetween.

16 Claims, 4 Drawing Sheets

SONAR TRANSDUCER

The present invention relates to underwater sonar transducers and more particularly to a sonar transducer with improved fracture resistance.

Sonar systems include a plurality of transducers which are connected to a central signal processor. The transducers are designed to operate in an underwater environment and include components which are capable of converting electrical energy to mechanical energy and visa versa. One type of sonar transducer which is currently in common use is known as Piezoelectric Ceramic Ring. It consists of a hollow cylinder or ring composed of piezoelectric ceramic material. The ring can be made of a single solid piece of ceramic or of ceramic staves or bars.

The ring operates in a "breather" or "hoop" mode, in which the diameter of the ring varies in response to acoustic energy impinging on its outer cylindrical surface, or in response to electrical energy applied to electrodes attached to the ring. The ring is usually mounted on a cylindrical member in the form of a metal core for mechanical support. Paper is wrapped around the core, prior to the installation of the ring, to provide mechanical support and to prevent the mechanical properties of the core from affecting the acoustic performance of the ring. The entire transducer is usually coated with a compliant water-proof material.

The dimensions of the ring are determined by the acoustic performance specifications. These specifications include the radiation pattern (determined by the outer diameter and height), the resonant frequency (determined by the mean diameter), the "Q" or operating bandwidth (determined by the mean diameter, wall thickness and height), and the power (determined by the mean diameter, wall thickness and height).

Paper is usually wrapped around the core prior to slipping the ring over the core. Several turns of paper are used, such that the total paper thickness is just enough to fill the gap between the outer diameter of the core and the inner diameter of ring. The paper thickness is dictated by acoustic performance considerations. In order for the ring to have the greatest possible resistance to fracture during mechanical shock, the paper must provide uniform support to all the parts of the inner cylindrical surface of the ring. This condition is difficult to achieve in practice, however, because the inner cylindrical surface of the ring is usually not uniformed. Any "high" spots will be in closer contact with the paper and any "low" spots may not contact the paper at all. The resulting non uniformed distribution of stresses can cause fracture of the ring during shock.

This problem is particularly severe in a transducer made from a segmented ring. The inner surface of this type of ring is not cylindrical, but rather polygonal, and consists of a number of "flats". Accordingly, a number of "v" shaped gaps (equal to the number of bars or segments) are present. This results in stress concentrations where fractures can be initiated.

Moreover, the combination of performance specifications and environmental specifications often result in a dimensional conflict. In particular, the dimensions required to meet certain performance specifications may result in a ring which is mechanically fragile and hence unable to meet the environmental specification for mechanical shock resistance. One problem which is encountered frequently is that the height required to meet the performance specifications results in a ring whose height-to-diameter or height-to wall thickness ratio is so large that the ring is unable to meet to the mechanical shock specifications.

It is, therefore, a prime object of the present invention to provide an improved sonar transducer with increased resistance to fracture resulting from mechanical shock.

It is another object of the present invention to provide an improved sonar transducer in which a potting compound is interposed between the paper and the ceramic element, so as to fill all of the gaps therebetween, reducing stress concentrations where fractures can be initiated.

It is another object of the present invention to provide an improved sonar transducer wherein the ceramic ring is formed of two axially aligned cylindrical ceramic subelements, such that both performance specifications and mechanical shock specifications can be met simultaneously.

In accordance with one aspect of the present invention, a sonar transducer of the type having energy conversion means is provided. The energy conversion means comprises substantially cylindrical support means and piezoelectric ceramic means situated around the support. Paper means is interposed between the support means and the ceramic means. The improvement comprises a layer of potting compound situated between the paper means and the ceramic means.

The ceramic means may either comprise a single part or a plurality of segments joined together.

The ceramic means comprises two substantially axially aligned, substantially cylindrical piezoelectric ceramic subelements. Preferably, each of the ceramic subelements comprises a plurality of segments or is composed of a single part. Gasket means are interposed between the subelements.

In accordance with another aspect of the present invention, a sonar transducer is provided comprising energy conversion means. The energy conversion means comprises substantially cylindrical support means, first and second substantially axially aligned; cylindrical piezoelectric ceramic subelements and gasket means interposed between the ceramic subelements, to form an assembly. The assembly is situated around the support means. Paper means are interposed between the support means and the assembly.

The subelements preferably comprise a plurality of segments joined together. However, the subelements may comprise a single part.

The transducer further comprises potting compound interposed between the paper means and the assembly.

To these and other such other objects which may hereinafter appear, the present invention relates to an improved sonar transducer as described in the following specification and recited in the annexed claims, taken together with the accompanying drawings, wherein like numerals refer to like parts and in which:

Figure 8:
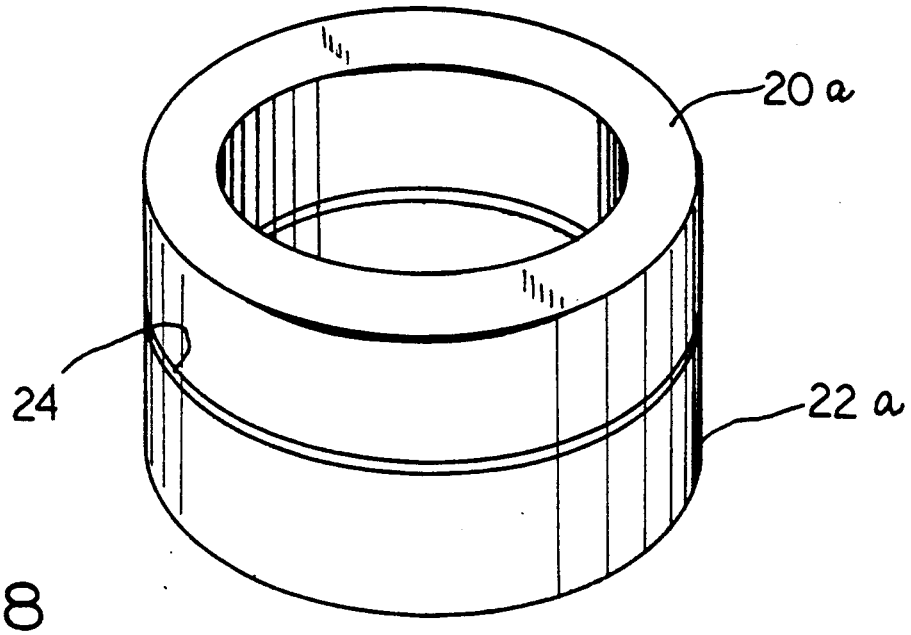
Figure 9:
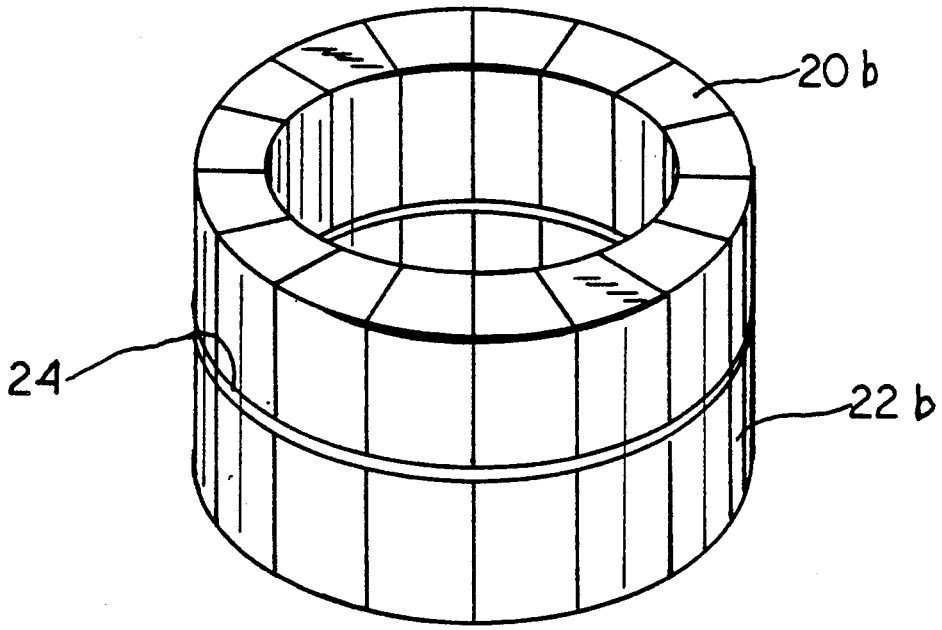

FIG. 8 is an isometric view of a second preferred embodiment of a ceramic ring element assembly formed of two, single part ceramic subelements of the present invention designed for use with a sonar transducer; and FIG. 9 is an isometric view of a second preferred embodiment of a ceramic ring element assembly formed of segmented ceramic subelements of the present invention for use with a sonar transducer.

Figure 1:
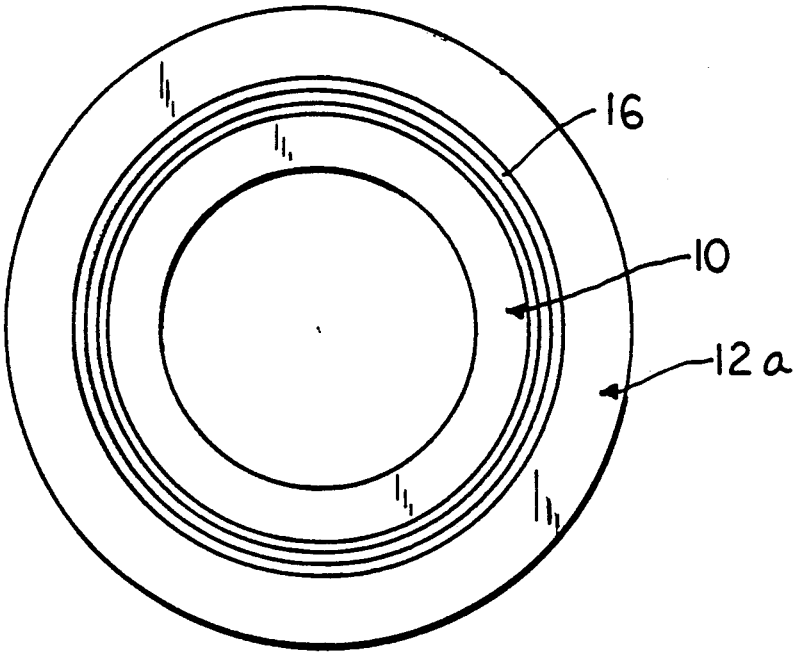
FIG. 1 PRIOR ART
FIG. 1 is an end view of prior art energy conversion means for a sonar transducer of the type which includes a ceramic ring element formed of a single part.
Figure 2:
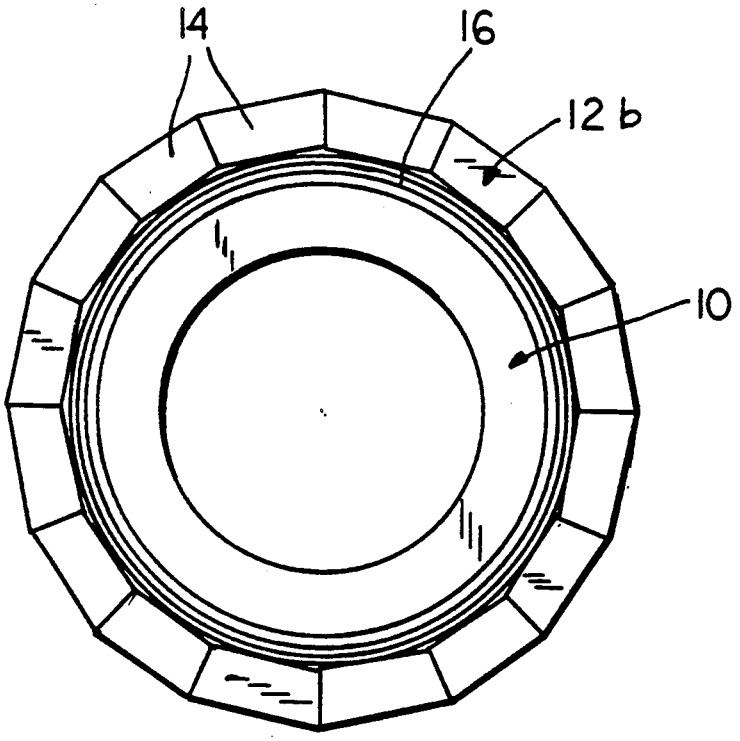
FIG. 2 PRIOR ART
FIG. 2 is an end view of prior art energy conversion means for a sonar transducer of the type which includes a ceramic ring element formed of a plurality of segments.

FIGS. 1 and 2 respectively illustrate prior art single part and segmented energy conversion means, each of which includes an inner support 10, preferably formed of a hollow cylindrical metal core. Surrounding support 10 is a substantially hollow cylindrical piezoelectric ceramic ring element 12. Ceramic ring element 12*a*, as depicted in FIG. 1, is made of a single, integral part. On the other hand, ceramic ring element 12*b*, as shown in FIG. 2, is segmented, being formed of a plurality of elongated ceramic bars 14 joined together by a layer of epoxy cement or other suitable adhesive.

Interposed between support 10 and the ceramic ring element 12 are a plurality of layers of paper 16. Several layers of paper are used so that the total paper thickness is just enough to fill the gap between the outer diameter of the support and the inner diameter of ceramic ring. The paper thickness is dictated by acoustical performance considerations.

In order for the ceramic ring element to have the greatest possible resistance to fracture due to mechanical shock, the paper 16 must provide uniform support to all parts of the inner surface of the ceramic ring. This condition is, however, difficult to achieve in practice because the inner surface of the ceramic ring is not precisely uniform. Accordingly, any "high" spots on the inner surface would in closer contact with the paper than "low" spots. This may result in a non-uniform distribution of stresses which can cause fracture of the ceramic ring during mechanical shock. This problem is particularly acute with respect to the segmented ring element embodiment illustrated in FIG. 2. Because the inner surface of the segmented ceramic ring element is not cylindrical, but rather polygonal, there are a number of "v" shaped gaps which are formed, resulting in stress concentrations where fractures can be initiated.

Figure 3:
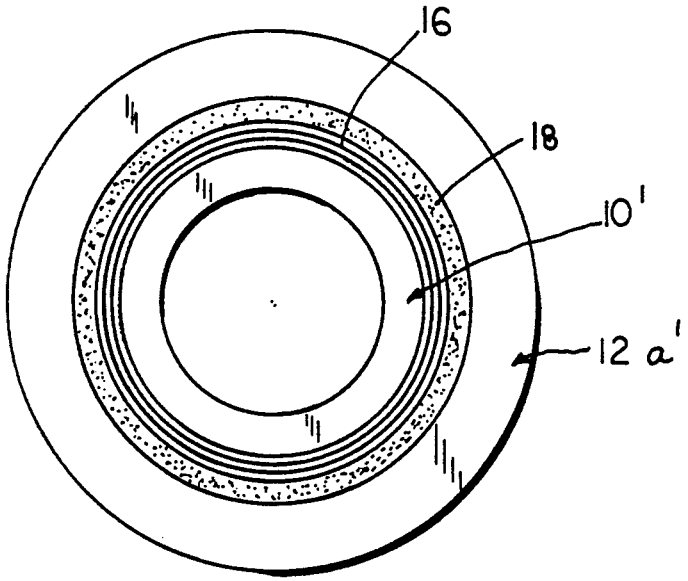
FIG. 3 is an end view of a first preferred embodiment energy conversion means for the sonar transducer of the present invention which includes a ceramic ring element formed of a single part.
Figure 4:
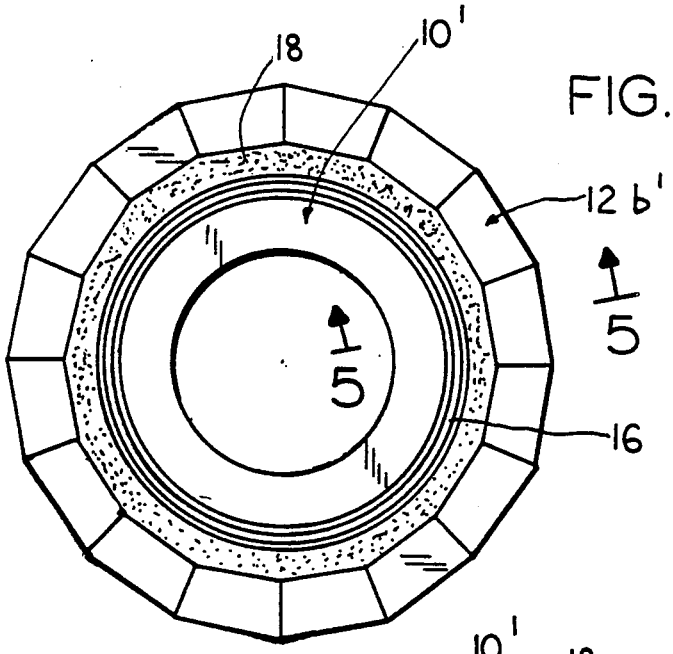
FIG. 4 is an end view of a first preferred embodiment energy conversion means for the sonar transducer of the present invention which includes a segmented ceramic ring element.
Figure 5:
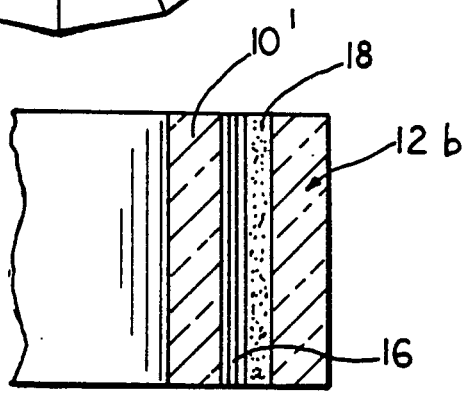
FIG. 5 is a partial cross-sectional view taken along line 5—5 of FIG. 4.

The first preferred embodiment of the present invention, shown in FIGS. 3, 4 and 5, is designed to improve the resistance of the ceramic ring element to fracture due to mechanical shock. In the present invention, the outer diameter of conventional support 10 is reduced slightly so as to form a cylindrical metal core 10'. After the required number of layers of paper 16 have been wrapped around the reduced diameter core 10', there will be a significant difference between the outer diameter of paper 16 and the inner diameter of the ceramic ring, which may be in the form of a single part 12*a*, as shown in FIG. 3, or a segmented ceramic ring 12*b*, as shown in FIG. 4. After the ceramic ring 12 is slipped over the paper 16, an annular gap between the paper and ring remains. This gap is filled with potting compound 18 which, when cured, has less compliance than the paper but more compliance than the ring. Since the potting compound 18 is in intimate contact with all parts of the paper outer surface and the interior surface of the ring, a much more uniform support is provided, thereby significantly increasing the resistance of the ring to fracture resulting from mechanical shock.

FIG. 3 illustrates an embodiment where the potting compound 18 is used in conjunction with a single part ceramic ring element 12*a*. FIG. 4 depicts an embodiment where the potting compound 18 is used in conjunction with a segmented ceramic ring 12*b*.

FIG. 5 is a partial cross-sectional view showing a portion of the energy conversion means of FIG. 4 and in particular, the fact that the potting compound 18 fills the gap between the paper 16 and the segmented ceramic ring 12*b* throughout the entire length of the device.

Figure 6:
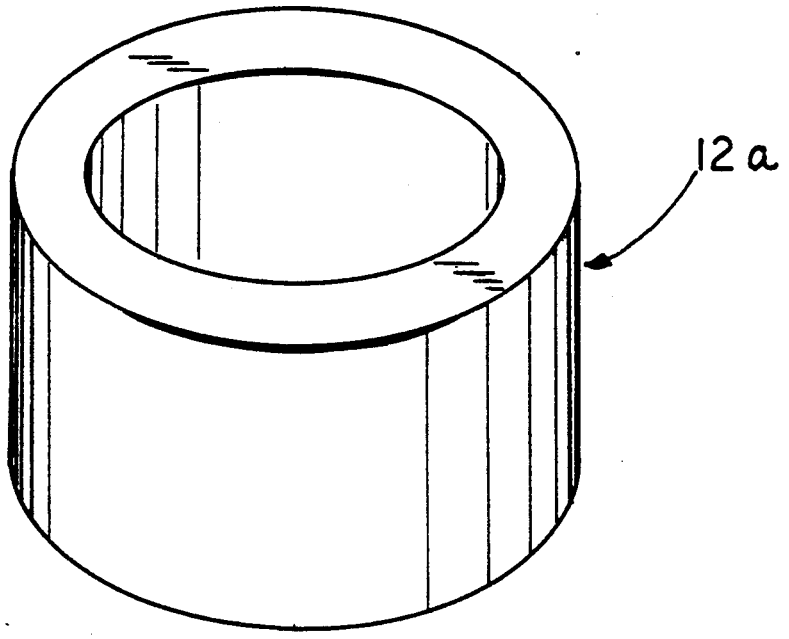
FIG. 6 PRIOR ART
FIG. 6 is an isometric view of a prior art single part ceramic ring element designed for use in a sonar transducer.
Figure 7:
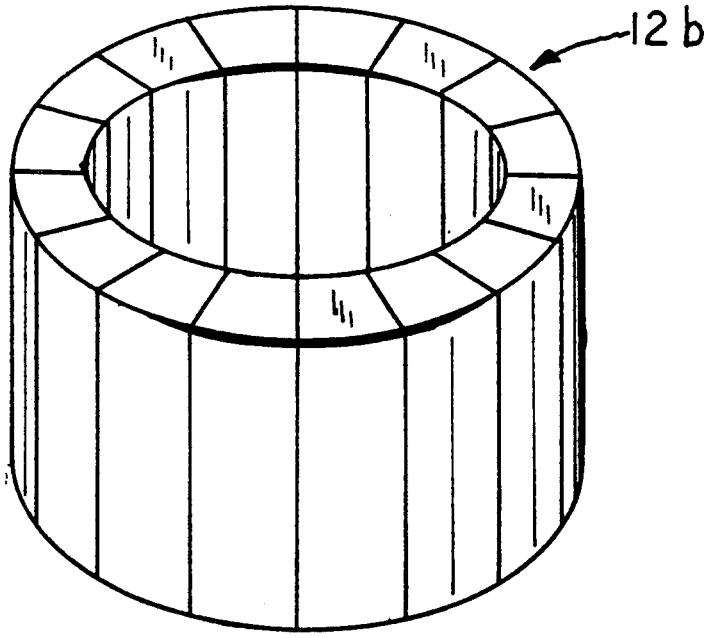
FIG. 7 PRIOR ART
FIG. 7 is an isometric view of a prior art segmented ceramic ring element designed for use in a sonar transducer.

FIGS. 6 and 7 respectively show prior art single part and segmented ceramic ring elements, prior to mounting on a core support. A single ceramic ring element, either of the single part type or the segmented type, was utilized for each transducer in the prior art. The dimensions of the ceramic ring are determined by the acoustic performance specifications. However, the acoustic performance specifications and the environmental specifications (shock resistance) often result in a dimensional conflict. The dimensions required to meet certain performance specifications may result in a ceramic ring which is mechanically fragile and unable to meet the environmental specification for mechanical shock resistance. In particular, the axial length or height of the ring required to meet the performance specifications results in a ring whose height-to- diameter or whose height-to-wall thickness ratio is so large that the ring is unable to meet the mechanical shock specifications.

The second preferred embodiment of the present invention achieves a total ring height by using two or more shorter axially aligned ring subelements, whose individual height, when added together, equal the total height required. As illustrated in FIGS. 8 and 9, each ceramic ring subelement, being relatively short in the axial direction, is mechanically much stronger than a single element of the same combined height. One or more gaskets 24 of compliant material are interposed between the subelements and allow each subelement to respond individually to shock, thereby retaining its shock resistance. The separation of the transducer into two or more axially aligned ceramic ring subelements has no adverse effect on its acoustical performance.

For some applications, resistance to fracture resulting from mechanical shock can be optimized by combining the structure of the first preferred embodiment, as shown in FIGS. 3, 4 and 5, with the structure of the second preferred embodiment, as disclosed in FIGS. 8 and 9. This will result in a sonar transducer with a ceramic ring element, either of the single part or segmented type, which is divided into two or more axially aligned subelements and which has a layer of cured potting compound interposed between the paper and the interior surfaces of the subelements.

It should now be appreciated that the present invention relates to a sonar transducer with improved resistance to mechanical shock. In one preferred embodiment, the mechanical shock resistance is improved due to the use of cured potting compound which is interposed between the paper layers and inner surface of the ring. In the second preferred embodiment, the improved mechanical shock resistance is a result of utilizing two or more axially aligned ceramic ring subelements with one or more gaskets interposed therebetween. In either embodiment, the rings may be formed of a single part or multiple segments.

While only a limited number of preferred embodiments have been disclosed herein for purposes of illustration, it is obvious that many variations and modifications could be made thereto. It is intended to cover all of the these variations and modifications which fall within the scope of the present invention, as defined by the following claims:

We claim:

1. In a sonar transducer of the type having energy conversion means, substantially cylindrical support means, substantially cylindrical piezoelectric ceramic ring means situated around said support means and paper means interposed between said support means and said ceramic ring means, the improvement comprising a layer of potting compound situated between said paper means and said ceramic ring means.

2. The transducer of claim 1 wherein said ceramic ring means comprises a plurality of segments joined together.

3. The transducer of claim 1 wherein said ceramic ring means is a single part.

4. The transducer of claim 1 wherein said ceramic ring means comprises two substantially axially aligned, substantially cylindrical piezoelectric ceramic ring subelements.

5. The transducer of claim 4 wherein each of said subelements comprises a plurality of segments.

6. The transducer of claim 4 wherein each of said subelements comprises a single part.

7. The transducer of claim 4, further comprising gasket means situated between said subelements.

8. A sonar transducer comprising energy conversion means, said energy conversion means comprising:

substantially cylindrical support means;

first and second substantially axially aligned and substantially cylindrical piezoelectric ceramic ring subelements;

gasket means interposed between said subelements to form an assembly, said assembly being adapted to be situated around said support means;

paper means interposed between said support means and said assembly; and a layer of potting compound interposed between said paper means and said assembly.

9. The transducer of claim 8 wherein each of said subelements comprises a plurality of segments joined together.

10. The transducer of claim 8 wherein each of said subelements comprises a single part.

11. The transducer of claim 1 wherein said potting compound, when cured, has more compliance than said ceramic ring, but less compliance than said paper means.

12. The transducer of claim 8 wherein said potting compound, when cured, has more compliance than said ceramic ring, but less compliance than said paper means.

13. A method of improving the shock resistance of a sonar transducer of the type having substantially cylindrical support means, substantially cylindrical piezoelectric ceramic ring means situated around said support means, and paper means interposed between said support means and said ceramic ring means, the method comprising the step of interposing a layer of potting compound between said paper means and said ceramic ring means and permitting said potting compound to cure.

14. The method of claim 13, wherein said ceramic ring means comprises a plurality of cylindrical rings, and said method includes the step of interposing gaskets of compliant material between said cylindrical rings.

15. A shock-absorbing acoustic transducer comprising:

(a) at least one piezoelectric ceramic element;

(b) a metallic support structure; and (c) shock absorbing means interposed between said at least one piezoelectric ceramic element and said support structure, said shock absorbing means comprising first and second layers, the first layer being disposed adjacent said support structure and said second layer being disposed adjacent said at least one piezoelectric ceramic element, said first layer being more compliant than said second layer.

16. The shock absorbing acoustic transducer of claim 15, wherein said support structure is cylindrical and wherein said at least one piezoelectric ceramic element is also cylindrical and is disposed around said support means.

* * * * *